US007802994B1

(12) United States Patent
Chen et al.

(10) Patent No.: US 7,802,994 B1
(45) Date of Patent: Sep. 28, 2010

(54) COMBINATION OF CONNECTOR ASSEMBLY AND TWO PRINTED CIRCUIT BOARDS

(75) Inventors: Chung-Yu Chen, Tu-Cheng (TW); Sheng-Nan Yu, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/385,330

(22) Filed: Apr. 6, 2009

(51) Int. Cl.
*H01R 12/00* (2006.01)

(52) U.S. Cl. ..... 439/65; 439/682

(58) Field of Classification Search ..... 439/65, 439/79, 31, 660, 682, 224
See application file for complete search history.

(56) References Cited

U.S. PATENT DOCUMENTS 4,877,409 A * 10/1989 Tanigawa et al. ..... 439/31
4,900,261 A * 2/1990 Gentry et al. ..... 439/353
5,316,489 A * 5/1994 Kachlic et al. ..... 439/79
6,027,353 A * 2/2000 Kamagai ..... 439/224
6,974,344 B2 * 12/2005 Comerci ..... 439/329
7,217,159 B2 * 5/2007 Chung ..... 439/607.01
7,422,451 B2 * 9/2008 Chen et al. ..... 439/101
7,448,873 B2 * 11/2008 Weber ..... 439/31

* cited by examiner

*Primary Examiner*—Xuong M Chung-Trans
(74) *Attorney, Agent, or Firm*—Rosenberg, Klein & Lee

(57) ABSTRACT

A combination of connector assembly and two printed circuit boards includes a first printed circuit board defining a guiding gap at one edge thereof and a second printed circuit board, a receptacle connector including a receptacle insulating housing and a plurality of receptacle terminals, a plug connector including a plug insulating housing and a plurality of plug terminals. The receptacle insulating housing defines a plurality of assisting channels penetrating through a bottom surface of the receptacle insulating housing in order to communicate with the guiding gap of the first printed circuit board. Each of the receptacle terminals has a pair of contact portions face-to-face stretching into the corresponding assisting channel. Each of the plug terminals has a contact arm stretching out of the plug insulating housing so as to pass through the guiding gap to be electrically clamped by the contact portions of the corresponding receptacle terminals.

7 Claims, 5 Drawing Sheets

COMBINATION OF CONNECTOR ASSEMBLY AND TWO PRINTED CIRCUIT BOARDS

BACKGROUND OF THE INVENTION

1. Field of the Invention

The present invention generally relates to a connector assembly, and more particularly to a combination of connector assembly and two printed circuit boards.

2. The Related Art

A traditional combination of connector assembly and two printed circuit boards includes a receptacle connector, a plug connector and two rectangular printed circuit boards. The receptacle connector includes a receptacle insulating housing and a plurality of receptacle terminals disposed in the receptacle insulating housing and soldered with one corresponding printed circuit board. The plug connector includes a plug insulating housing and a plurality of plug terminals disposed in the plug insulating housing and soldered with the other printed circuit board. When the receptacle connector is mated with the plug connector, the plug terminals are inserted into the receptacle insulating housing for electrically connecting the corresponding receptacle terminals so as to form an electrical connection between the two printed circuit boards. However, the plug connector is mated with the receptacle connector only by directly face-to-face insertion and opposite withdrawal. As a result, the assembly and the separation of the receptacle connector and the plug connector are sometimes inconvenient because of the limit of insertion/withdrawal directions and the printed circuit board shape.

SUMMARY OF THE INVENTION

An object of the present invention is to provide a combination of connector assembly and two printed circuit boards. The combination of connector assembly and two printed circuit boards includes a first printed circuit board defining a guiding gap at one edge thereof and a second printed circuit board, a receptacle connector and a plug connector mated with the receptacle connector. The receptacle connector includes a receptacle insulating housing and a plurality of receptacle terminals disposed in the receptacle insulating housing and electrically connected with the first printed circuit board. The receptacle insulating housing is disposed on the first printed circuit board and traverses the guiding gap. The receptacle insulating housing defines a plurality of assisting channels at a rear surface thereof. The assisting channels penetrates through a bottom surface of the receptacle insulating housing in order to communicate with the guiding gap of the first printed circuit board. Each of the receptacle terminals has a pair of clamping arms facing each other. Two of contact portions are formed at the corresponding clamping arms and face-to-face stretch into the corresponding assisting channel. The plug connector includes a plug insulating housing disposed on the second printed circuit board and a plurality of plug terminals disposed in the plug insulating housing and electrically connected with the second printed circuit board. Each of the plug terminals has a contact arm stretching out of the plug insulating housing and beyond one edge of the second printed circuit board so as to pass through the guiding gap to be electrically clamped by the contact portions of the corresponding receptacle terminal.

As described above, the guiding gap of the first printed circuit board is opened to communicate with the assisting channels of the receptacle connector, so that overcomes the shape limit of the printed circuit boards, and facilitates the assembly and the separation of the receptacle connector and the plug connector.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
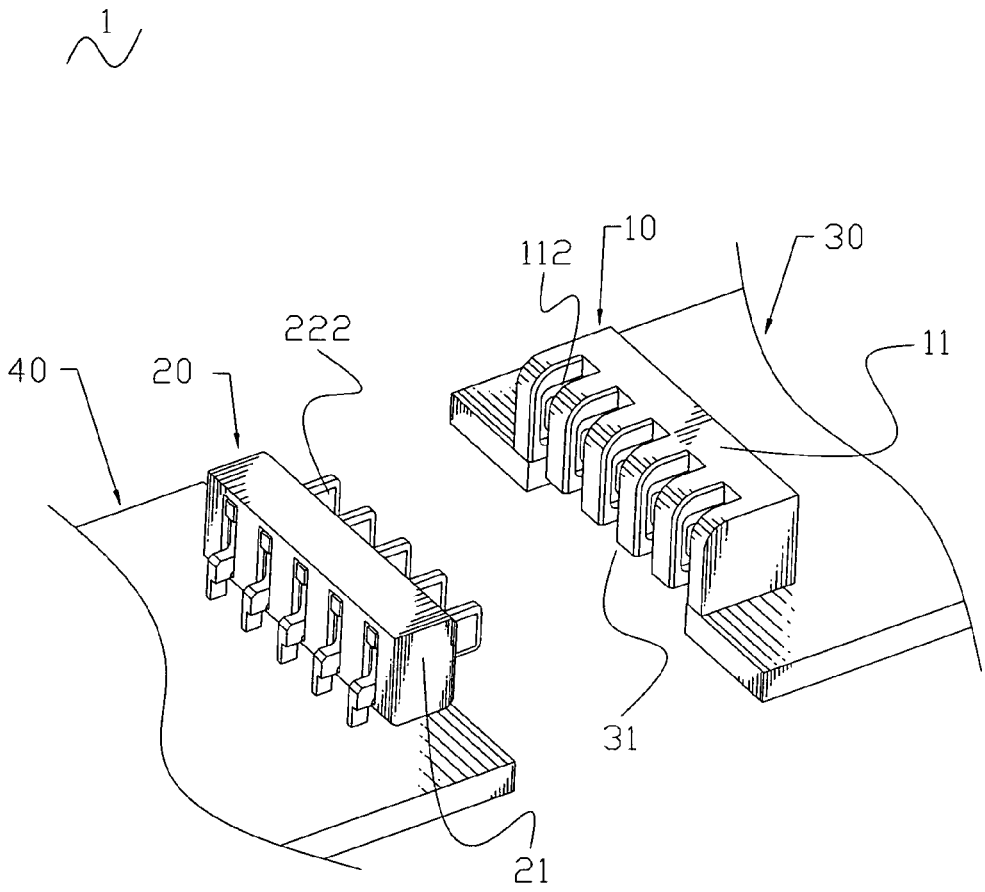
FIG. 1 is a perspective view of a combination of connector assembly and two printed circuit boards according to the present invention.

With reference to FIG. 1, a combination 1 of connector assembly and two printed circuit boards according to the present invention includes a receptacle connector 10, a plug connector 20 mated with the receptacle connector 10, a first printed circuit board 30 electrically connected with the receptacle connector 10 and a second printed circuit board 40 electrically connected with the plug connector 20.

Figure 2:
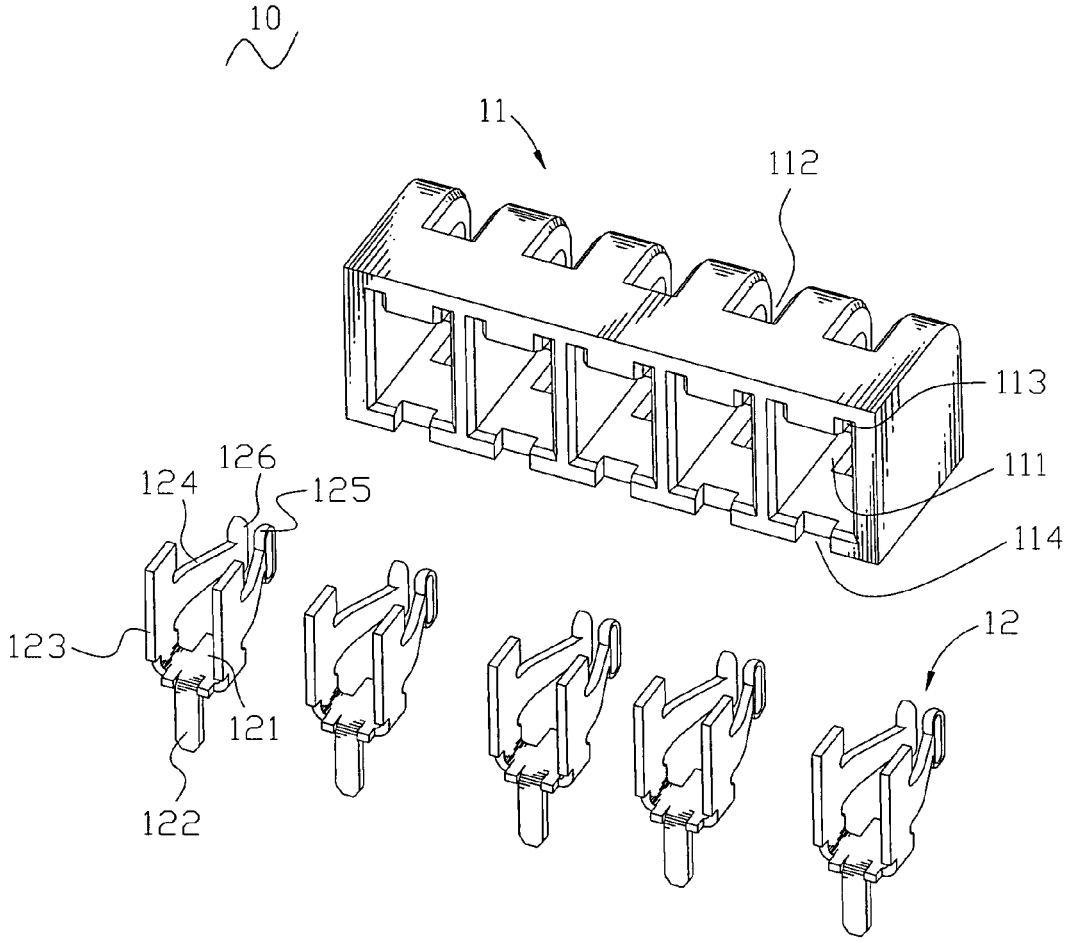
FIG. 2 is an exploded view of a receptacle connector of the combination of FIG. 1.

With reference to FIG. 2, the receptacle connector 10 includes a receptacle insulating housing 11 of substantially rectangular shape and a plurality of receptacle terminals 12 disposed in the receptacle insulating housing 11. The receptacle insulating housing 11 defines a plurality of rectangular receiving cavities 111 arranged at regular intervals along a longwise direction thereof and each passing through a front surface thereof. The receptacle insulating housing 11 further defines a plurality of rectangular assisting channels 112 each vertically to penetrate through a top surface, a bottom surface and a rear surface thereof and communicating with a rear middle of the corresponding receiving cavity 111. Two sides of a top of each of the receiving cavities 111 define a pair of fixing grooves 113 each extending longitudinally to pass through the front surface of the receptacle insulating housing 11. A front of a bottom of each of the receiving cavities 111 defines a holding gap 114 at a middle thereof passing through the bottom surface of the receptacle insulating housing 11 and having a front end opened freely.

Referring to FIG. 2 again, each of the receptacle terminals 12 has a rectangular base board 121 extending longitudinally. A middle of a front end of the base board 121 is bent downwards and then perpendicularly extends to form a soldering portion 122. Two opposite side edges of the base board 121 extend towards a same direction opposite to the soldering portion 122 to form a pair of fixing portions 123. A pair of clamping arms 124 extends rearward from front edges of the corresponding fixing portions 123 and inclines toward each other. Two free ends of the clamping arms 124 define a pair of contact portions 125 facing each other and each having a semi-elliptic shape. Accordingly, an inner surface of each of the contact portions 125 is served as a smooth semi-elliptic guiding surface 126.

Figure 3:
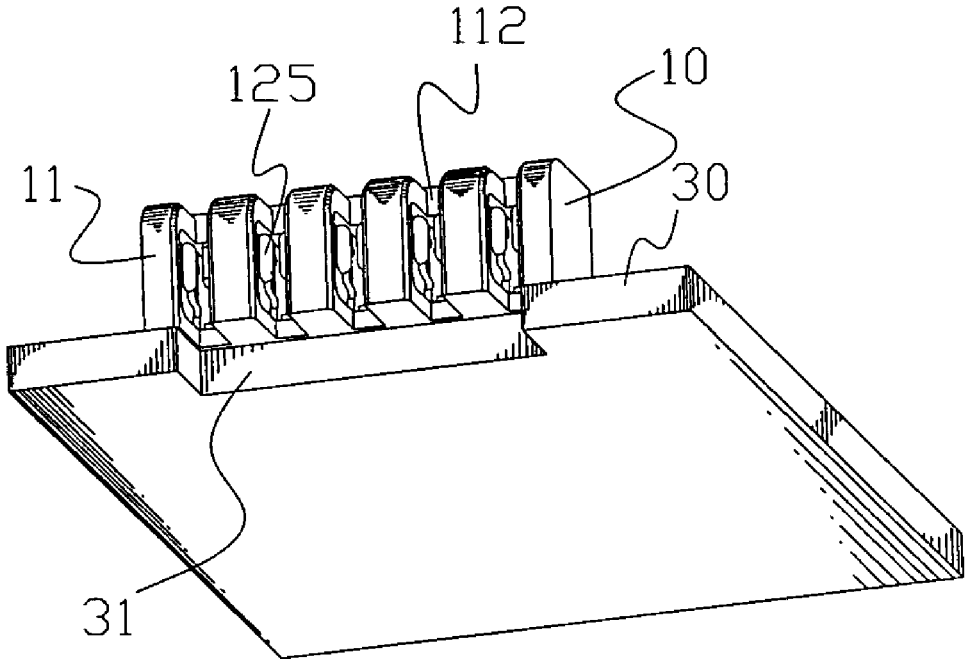
FIG. 3 is a perspective view of the receptacle connector with a first printed circuit board.
Figure 5:
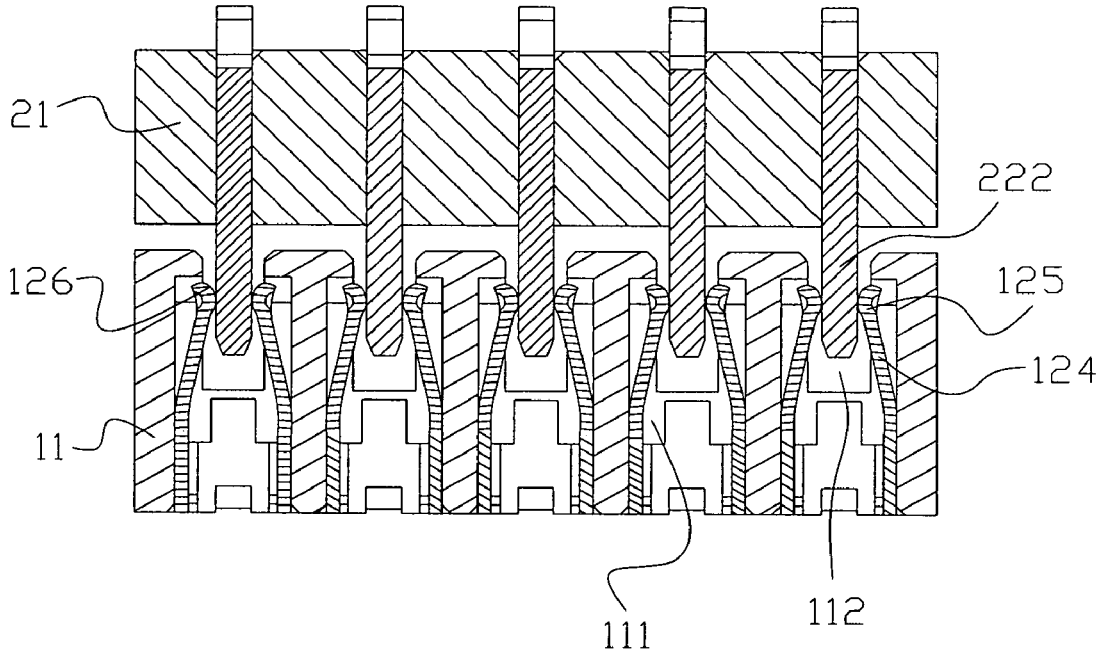
FIG. 5 is a cross-sectional view showing that the receptacle connector is mated with the plug connector.

Referring to FIG. 1, FIG. 3 and FIG. 5, when the receptacle connector 10 is assembled, the receptacle terminals 12 are respectively disposed in the receptacle insulating housing 11.

The base board 121 and the fixing portions 123 of the receptacle terminal 12 are received in the corresponding receiving cavity 111. The clamping arms 124 are also received in the corresponding receiving cavity 111 and located at two opposite sides of the corresponding assisting channel 112. The contact portions 125 face-to-face extend into the corresponding assisting channel 112. A top end of each of the fixing portions 123 is fixed in the corresponding fixing groove 113 so as to retain a firm combination between the receptacle terminal 12 and the receptacle insulating housing 11. The soldering portion 122 is held in the corresponding holding gap 114 and stretches beyond the bottom surface of the receptacle insulating housing 11 for being soldered with the first printed circuit board 30. The first printed circuit board 30 has a rectangular guiding gap 31 at a rear edge thereof. The receptacle insulating housing 11 is fastened on the first printed circuit board 30 and traverses the guiding gap 31 so as to make the assisting channels 112 communicate with the guiding gap 31. A rear edge of the receptacle insulating housing 11 corresponds to the rear edge of the first printed circuit board 30.

Figure 4:
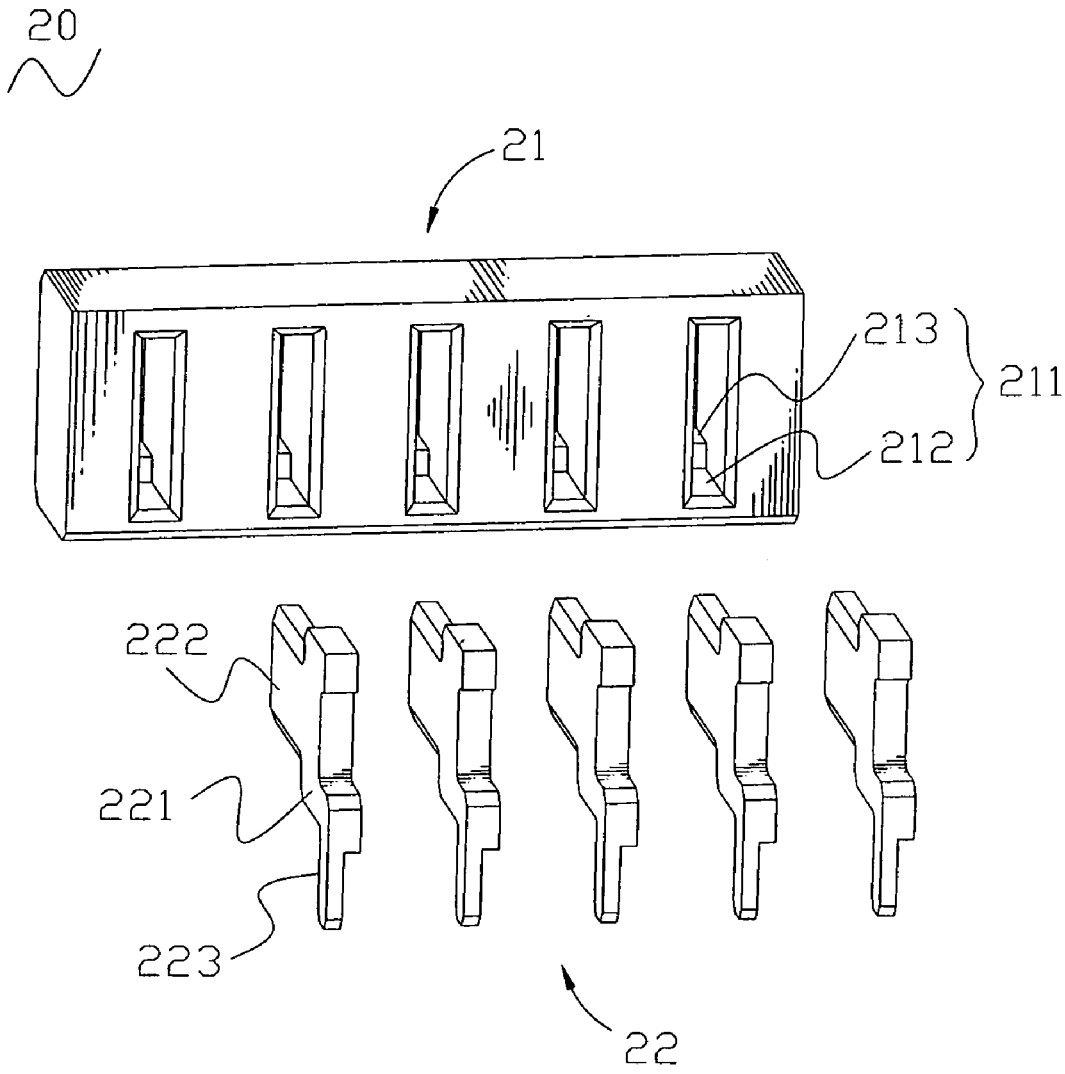
FIG. 4 is an exploded view of a plug connector of the combination of FIG. 1.

With reference to FIG. 4, the plug connector 20 includes a plug insulating housing 21 of rectangular shape and a plurality of plug terminals 22 disposed in the plug insulating housing 21. The plug insulating housing 21 defines a plurality of terminal passageways 211 arranged at regular intervals along a longwise direction thereof and each passing through a rear surface and a front surface thereof. Each of the terminal passageways 211 includes a rectangular holding fillister 212 at a rear thereof and an inserting fillister 213 extending forward from a middle of the corresponding holding fillister 212.

Referring to FIG. 4 again, each of the plug terminals 22 has a rectangular holding portion 221 extending vertically, a contact arm 222 extending forward from a middle of a front edge of the holding portion 221, and a soldering tail 223 protruding rearward and then extending downward from a bottom of a rear edge of the holding portion 221.

Referring to FIG. 1 and FIG. 4, when the plug connector 20 is assembled, the plug terminals 22 are received in the corresponding terminal passageways 211 of the plug insulating housing 21. The holding portion 221 of the plug terminal 22 is held in the corresponding holding fillister 212. The contact arm 222 is inserted into the corresponding inserting fillister 213 and partly stretches out of the front surface of the plug insulating housing 21. The soldering tail 223 is out of the plug insulating housing 21 for being soldered with the second printed circuit board 40. The plug insulating housing 21 of the plug connector 20 is fastened on the second printed circuit board 40, and a front edge of the plug insulating housing 21 corresponds to a front edge of the second printed circuit board 40.

Referring to FIG. 1 and FIG. 5, when the first printed circuit board 30 and the second printed circuit board 40 are needed to transmit electrical signals with each other, the receptacle connector 10 is mated with the plug connector 20. In the process of the mating, because the assisting channels 112 of the receptacle insulating housing 11 communicate with the guiding gap 31 of the first printed circuit board 30, the contact arms 222 of the plug terminals 22 can pass through the guiding gap 31 of the first printed circuit board 30, and insert into the corresponding assisting channels 112 from bottom to top. Then the contact arm 222 of each of the plug terminals 22 is guided by the guiding surfaces 126 of the corresponding receptacle terminal 12 to be further inserted between the corresponding two clamping arms 124 and is electrically clamped by the corresponding contact portions 125 so as to form an electrical connection between the receptacle connector 10 and the plug connector 20. As a result, the electrical signals can be transmitted between the first printed circuit board 30 and the second printed circuit board 40. When the plug connector 20 is completely mated with the receptacle connector 10, the rear edge of the first printed circuit board 30 is matched with the front edge of the second printed circuit board 40. When the plug connector 20 is pulled off from the receptacle connector 10, the contact arms 222 of the plug terminals 22 will slide downward along the guiding surfaces 126 of the corresponding receptacle terminals 12 so as to separate from the contact portions 125, and then pass through the bottom of the assisting channels 112 and the guiding gap 31. Such that the electrical signals transmission between the printed circuit boards 30, 40 is broken. Furthermore, in the embodiment, the contact arms 222 of the plug terminals 22 can be inserted into or pulled off from the corresponding guiding surfaces 126 of the receptacle terminal 12 from several different directions because the guiding surface 126 is of semi-elliptical shape.

As described above, the guiding gap 31 of the first printed circuit board 30 is opened to communicate with the assisting channels 112 of the receptacle connector 10, so that overcomes the shape limit of the printed circuit boards 30, 40 and facilitates the assembly and the separation of the receptacle connector 10 and the plug connector 20. Furthermore, because the guiding surface 126 of the receptacle terminal 12 is of semi-elliptical shape, so the plug terminals 22 can be inserted into or pulled off the corresponding receptacle terminals 12 from various directions so as to further facilitate the assembly and the separation of the receptacle connector 10 and the plug connector 20.

The forgoing description of the present invention has been presented for the purposes of illustration and description. It is not intended to be exhaustive or to limit the invention to the precise form disclosed, and obviously many modifications and variations that may be apparent to those skilled in the art are intended to be included within the scope of this invention as defined by the accompanying claims.

What is claimed is:

1. A combination of a connector assembly and two printed circuit boards, comprising:

a first printed circuit board having a guiding gap formed in one edge thereof and a second printed circuit board;

a receptacle connector including:

a receptacle insulating housing disposed on the first printed circuit board and spanning the guiding gap, the receptacle insulating housing having a plurality of assisting channels formed in a rear portion thereof, the assisting channels penetrating through a top surface, a rear surface and a bottom surface of the receptacle insulating housing and being in open communication with the guiding gap of the first printed circuit board, and a plurality of receptacle terminals disposed in the receptacle insulating housing and electrically connected with the first printed circuit board, each of the receptacle terminals having a pair of clamping arms facing each other, and a pair of face-to-face contact portions formed at corresponding ends of the clamping arms, said clamping arms being inclined toward each other and extending into a corresponding assisting channel; and a plug connector mated with the receptacle connector and including:

a plug insulating housing disposed on the second printed circuit board, and a plurality of plug terminals disposed in the plug insulating housing and electrically connected with the second printed circuit board, each of the plug terminals having a contact arm extending outwardly from the plug insulating housing and beyond one edge of the second printed circuit board for passing through the guiding gap to enter into the corresponding assisting channel and being electrically clamped by the contact portions of the corresponding receptacle terminal.

2. The combination of a connector assembly and two printed circuit boards as claimed in claim 1, wherein an inner surface of the contact portion of each clamping arm is formed with a substantially semi-elliptical guiding surface for guiding the corresponding contact arm.

3. The combination of a connector assembly and two printed circuit boards as claimed in claim 1, wherein the rear surface of the receptacle insulating housing corresponds to the rear edge of the corresponding printed circuit board, and the plug insulating housing is disposed to correspond to the one edge of the other printed circuit board, so as to make the two printed circuit boards matched with each other after the combination is completed.

4. The combination of a connector assembly and two printed circuit boards as claimed in claim 1, wherein the receptacle insulating housing defines a plurality of receiving cavities each passing through a front surface thereof and connected with the corresponding assisting channel, each of the receptacle terminals further has a base board, two opposite side edges of the base board extend towards a same direction to form a pair of fixing portions, the base board and the fixing portions are received in the corresponding receiving cavity, the pair of clamping arms are formed by extending towards a same direction from the corresponding fixing portions and inclining toward each other, the pair of contact portions are face-to-face formed at two free ends of the clamping arms.

5. The combination of a connector assembly and two printed circuit boards as claimed in claim 4, wherein one end of the base board is bent downwards and then extends towards a direction opposite to the fixing portions to form a soldering portion stretching out of the receptacle insulating housing for being soldered with the corresponding printed circuit board.

6. The combination of a connector assembly and two printed circuit boards as claimed in claim 5, wherein each of the receiving cavities defines a pair of fixing grooves further concaved inward, two free ends of the fixing portions of each of the receptacle terminals are fixed in the corresponding fixing grooves.

7. The combination of a connector assembly and two printed circuit boards as claimed in claim 1, wherein each of the plug terminals further has a holding portion fastened in the plug insulating housing and a soldering tail extending from one edge of the holding portion for being soldered with the other corresponding printed circuit board, the contact arm is formed by extending from the other edge of the holding portion opposite to the soldering tail.

* * * * *